US008402723B2

(12) United States Patent
Granili

(10) Patent No.: US 8,402,723 B2
(45) Date of Patent: Mar. 26, 2013

(54) VACUUM SKIN PACKAGING METHOD AND APPARATUS

(75) Inventor: Andrea Granili, Lainate (IT)

(73) Assignee: Cryovac, Inc., Duncan, SC (US)

( * ) Notice: Subject to any disclaimer, the term of this patent is extended or adjusted under 35 U.S.C. 154(b) by 488 days.

(21) Appl. No.: 12/452,729

(22) PCT Filed: Jul. 3, 2008

(86) PCT No.: PCT/EP2008/005474

§ 371 (c)(1),
(2), (4) Date: Jan. 19, 2010

(87) PCT Pub. No.: WO2009/010197

PCT Pub. Date: Jan. 22, 2009

(65) Prior Publication Data

US 2010/0115890 A1 May 13, 2010

(30) Foreign Application Priority Data

Jul. 16, 2007 (EP) ..... 07013857

(51) Int. Cl.
*B65B 11/52* (2006.01)

(52) U.S. Cl. ..... 53/427; 53/428; 53/432; 53/442; 53/509; 53/511

(58) Field of Classification Search ..... 53/428, 53/432, 434, 440, 441, 442, 509, 427, 456, 53/433, 511
See application file for complete search history.

(56) References Cited

U.S. PATENT DOCUMENTS 3,694,991 A 10/1972 Perdue et al.
3,835,618 A 9/1974 Perdue
3,950,919 A 4/1976 Perdue
4,410,089 A * 10/1983 Bortolani ..... 206/484
4,881,359 A 11/1989 Schirmer
5,048,268 A 9/1991 Brembilla et al.
5,106,670 A 4/1992 Wyslotsky et al.
(Continued)

FOREIGN PATENT DOCUMENTS

EP 0415521 3/1991
GB 1296013 11/1972
(Continued)

*Primary Examiner* — Christopher Harmon
(74) *Attorney, Agent, or Firm* — Daniel B. Ruble

(57) ABSTRACT

A method for the manufacture of a vacuum skin package where the lower support member is formed in a suitably selected shape which process comprises feeding a flat lower web (3) of thermoplastic material with the product (6) to be packaged loaded thereon and an upper thermoplastic web (27), to a vacuum chamber (8) for skin packaging that comprises an upper element (9) comprising a heated upper concavity (11) and a lower element (10) comprising a female vacuum forming mould (16) suitably shaped to match the desired shape for the support member of the end package, closing the vacuum chamber (8) and drawing the upper web (27) toward the upper concavity (11) by differential pressure; evacuating air or gases from the space between the lower web (3) and the upper web (27), in the closed vacuum chamber (8), while maintaining the vacuum from above the upper web and from below the lower supporting web; and reintroducing air from above the upper film, thus moving the heated upper web (27) against the product (6) and the lower supporting web (3), thereby vacuum forming the lower supporting web (3) against the suitably shaped female mould cavity (19) in the lower element and bonding the upper web (27) to the lower supporting web (3) all around the product (6) to form a hermetically sealed skin package.

20 Claims, 3 Drawing Sheets

U.S. PATENT DOCUMENTS

| | | | | |
|---|---|---|---|---|
| 5,330,777 | A * | 7/1994 | Mize et al. | 426/383 |
| 5,631,036 | A | 5/1997 | Davis | |
| 7,370,456 | B2 * | 5/2008 | Ichikawa et al. | 53/493 |
| 7,487,625 | B2 * | 2/2009 | Natterer et al. | 53/433 |
| 7,803,416 | B2 * | 9/2010 | Roveda et al. | 426/396 |
| 2006/0230708 | A1 | 10/2006 | Granili | |

FOREIGN PATENT DOCUMENTS

| | | |
|---|---|---|
| GB | 2271545 | 4/1994 |
| WO | WO 2004074106 | 9/2004 |

* cited by examiner

VACUUM SKIN PACKAGING METHOD AND APPARATUS

The present invention relates to a new process for the vacuum skin packaging (VSP) of food and non food products and to the apparatus that is used to carry out the method.

Vacuum skin packaging is a vacuum packaging process well known in the art where thermoplastic packaging materials are used to enclose a product under vacuum. The vacuum skin packaging process is in one sense a type of thermoforming process in which an article to be packaged serves as the mould for the forming upper web. More particularly, in vacuum skin packaging an article is placed on a lower support member and the supported article is then passed in a chamber where a formable top film is drawn upward against a heated dome and is then draped down over the article. The movement of the upper web is controlled by vacuum and/or air pressure, and in a vacuum skin packaging arrangement, the interior of the container, i.e., the space between the lower support web and the upper or top web, is vacuumized before final welding of the top web to the support web. In a vacuum skin package the upper film thus forms a tight skin around the product and is sealed to the support all around the product.

Skin packaging is described in many references, including French Patent No. 1,258,357, French Patent No. 1,286,018, Australian Patent No. 3,491,504, U.S. Pat. No. RE 30,009, U.S. Pat. No. 3,574,642, U.S. Pat. No. 3,681,092, U.S. Pat. No. 3,713,849, U.S. Pat. No. 4,055,672, and U.S. Pat. No. 5,346,735.

In order to obtain packages with an appealable appearance, the first step in the vacuum skin packaging processes actually in use, is the in-line thermoforming of the lower web done in a conventional thermoforming station positioned before the product loading station and the vacuum chamber. The thermoforming step gives to the originally flat lower web a substantially tray-shape configuration, i.e., a configuration characterized by a bottom wall and upwardly and outwardly extending side walls around said bottom wall, preferably all around the perimeter of said bottom wall. This will not only provide a better appearance to the end package but will also improve its effectiveness because the packaged product will not tend to slip outside the package when the top web is removed and the package is opened but will remain in the recess created by shaping the base tray in the lower web.

Depending on the width of the lower web and on the size of the products to be packaged, there may be one or a plurality of connected trays formed in the lower web per cycle of the thermoforming station. The trays are then loaded with the products, and conveyed into the vacuum chamber of the skin packaging station. The vacuum chamber comprises an upper element and a lower element that close together to create the air-tight vacuum chamber. The lower element of the vacuum chamber generally comprises a mould having the same size and shape of the mould used in the thermoforming step and a vacuum is then drawn through said mould to keep the portion of the lower web which comprises the thermoformed tray or the plurality of connected thermoformed trays in their place within the lower chamber during the vacuum cycle. The upper element of the vacuum chamber comprises a dome that is heated during the vacuum cycle and that may optionally be divided in a plurality of heated cavities if a plurality of trays enter the chamber in each cycle. During the vacuum skin packaging process the upper film web is first drawn towards the upper dome by suction, then or at the same time the area between the upper and the lower webs is evacuated and once the upper web is heated enough to be softened, air is re-entered into the chamber from above the upper web thus draping down said web all around the packaged product and sealing it to the lower web wherever the two contact each other.

Once the chamber has been revented, it is opened and if an array of packages is obtained, this is typically brought to a cutting station where the packages are separated one from the other by means of knives or other cutting devices or systems.

Such a packaging process however has poor flexibility. Whenever it becomes necessary to change the size, shape or number of trays per packaging cycle, it is in fact necessary to change the toolings in the various stations, i.e., in the thermoforming station, in the vacuum chamber and in the cutting station. This means that the user needs to have a complete set of toolings for each arrangement that can be foreseen and space enough to store these toolings not too far from the packaging machine. Furthermore whenever he has to change size or shape to the packages, the machine should be stopped for a time sufficient to change the toolings at all the three stations.

There is a need therefore to increase the flexibility of this packaging system that is otherwise highly appreciated.

SUMMARY OF THE INVENTION

It has now been discovered that in a VSP cycle the heated top web that collapses toward the lower, or bottom, web and eventually drapes down all around the product, sealing to the bottom web in those regions where the two webs contact each other, is able to transmit sufficient heat to said bottom web to allow its formation from a flat sheet into the desired tray-like shape directly into the vacuum chamber, thus making the first separate step of thermoforming the bottom web superfluous.

The present invention is therefore directed to a process for the manufacture of a VSP package where the lower supporting web is shaped, wherein the separate step of thermoforming said lower web before loading it, is avoided and said forming step, to give to the lower web the desired tray-like shape, is carried out directly in the vacuum chamber. This not only will reduce the number of different toolings that would be needed by the user but will also allow a much faster machine set-up whenever a change in size, number or dimensions of the trays is needed, with a reduced loss of productivity.

A first object of the present invention is therefore a method for the manufacture of a vacuum skin package where a product is enclosed between a lower support member formed in a suitably selected shape and an upper film draped over the product and sealed to the support member in those regions all around the product where the two contact each other, which process comprises the following steps:

a) suitably positioning the product to be packaged on a flat lower supporting web of thermoplastic material;
b) feeding said flat lower supporting web loaded with the product and an upper thermoplastic web, positioned above the lower supporting member and the product, to a vacuum chamber for skin packaging, which chamber comprises an upper element comprising a heated upper concavity and a lower element comprising a female vacuum forming mould suitably shaped to match the desired shape for the support member of the end package;
c) closing the upper element and the lower element of the vacuum chamber together to provide an air tight vacuum chamber and drawing the upper web toward the upper concavity by differential pressure;
d) evacuating air or gases from the space between the lower and upper webs in the closed vacuum chamber, while maintaining the vacuum from above the upper web and from below the lower supporting web;

e) reintroducing air from above the upper film, thus moving the heated upper web against the product and the lower supporting web, thereby vacuum forming the lower supporting web against the suitably shaped female mould cavity in the lower element and bonding the upper web to the lower supporting web all around the product to form a hermetically sealed skin package, and f) releasing the vacuum from the lower element, opening the vacuum chamber and optionally severing the package thus formed.

In a preferred embodiment, a plurality of packages, each containing at least one product, are made in the vacuum skin packaging chamber per vacuum cycle. This is achieved by the same process as above but using a multi-impression female mould in the lower element of the vacuum chamber.

A second object of the present invention is an apparatus for the manufacture of a vacuum skin package of a product between a lower supporting web and an upper skin web, where the lower support member of the vacuum skin package is suitably shaped, said apparatus comprising i) means for suitably positioning the product to be packaged on a flat lower supporting web, ii) means for feeding said flat web with the product loaded thereon to an open skin packaging vacuum chamber which chamber comprises an upper element comprising a heated upper concavity and a lower element comprising a female vacuum forming mould suitably shaped to match the desired shape for the lower support member of the end package, iii) means for feeding an upper formable web over and above the lower supporting member and the product to the open vacuum chamber, iv) means for closing and opening the vacuum chamber, v) vacuumizing/reventing means in both the upper and the lower elements of the vacuum chamber for carrying out the skin vacuum cycle and the vacuum forming of the lower supporting web, and vi) optionally, means for severing the connected end packages, said apparatus being characterised in that it does not comprise any other separate means (station) for the thermoforming of the lower supporting web.

DEFINITIONS

As used herein the term "film" refers to a planar thermoplastic material, generally in the form of a discrete sheet or a web, with a thickness that can be up to 500 μm.

The terms "bottom web", "lower web", or "support web" refer to the web of packaging material on which the product to be packaged is disposed, while the terms "upper web" or "top web" refer to the web of packaging material that will be over the product and will be covering it in the packaging process.

The term "support member" is the component of the end package on which the packaged product is disposed.

As used herein the terms "formed" or "shaped" when referred to the bottom, lower, or support web refer to the tridimensional result of the vacuum forming of the bottom, lower, or support web in the vacuum chamber to create what would then be the tray-like container of the end package. When referred to the support member of the end package said terms are used to mean that said support member has a tray-like tridimensional configuration.

As used herein the terms "flexible", "semi-flexible", and "semi-rigid", are used to identify films which are thin enough to be possibly flexed, folded, and/or creased without cracking, wherein "semi-rigid" films are at the same time also thick enough to be self-supporting.

The terms "a product" and "the product" are used in the present text in the singular form only for the sake of conciseness but should be read as actually referring to either one or more products. In particular the claimed process encompasses not only the manufacture per vacuum cycle of a single package that may contain one or a plurality of products but also the manufacture per vacuum cycle of a plurality of packages each one containing one or a plurality of products.

As used herein the term gas-barrier or oxygen-barrier when referred to a layer or to an overall structure, is used to identify layers or structures characterized by an Oxygen Transmission Rate (evaluated at 23° C. and 0% R.H. according to ASTM D-3985) of less than 500 $cm^3/m^2 \cdot day \cdot bar$. Examples of thermoplastic materials that would provide such gas-barrier properties are e.g., PVDC, polyamides, EVOH, polyesters, blends thereof, etc.

As used herein the term polyolefin is meant to include homo-polymers of olefin, co-polymers of olefin, co-polymers of an olefin and an non-olefinic co-monomer co-polymerizable with the olefin, such as vinyl monomers, modified polymers thereof, and the like. Specific examples include polyethylene homo-polymer, polypropylene homo-polymer, polybutene homo-polymer, ethylene-α-olefin co-polymer, propylene-α-olefin co-polymer, butene-α-olefin co-polymer, ethylene-unsaturated ester co-polymer, ethylene-unsaturated acid co-polymer, (e.g. ethylene-ethyl acrylate co-polymer, ethylene-butyl acrylate co-polymer, ethylene-methyl acrylate co-polymer, ethylene-acrylic acid co-polymer, and ethylene-methacrylic acid co-polymer), ethylene-vinyl acetate copolymer, ionomer resin, polymethylpentene, etc., and those polymers obtained by copolymerizing the polyolefin or incorporating therein, by grafting or blending, an unsaturated carboxylic acid, e.g., maleic acid, fumaric acid or the like, or a derivative thereof such as the anhydride, ester or metal salt or the like.

BRIEF DESCRIPTION OF THE FIGURES OF THE DRAWING

The same reference numbers will be used throughout the following description for indicating the same or functionally equivalent parts.

Figure 1:
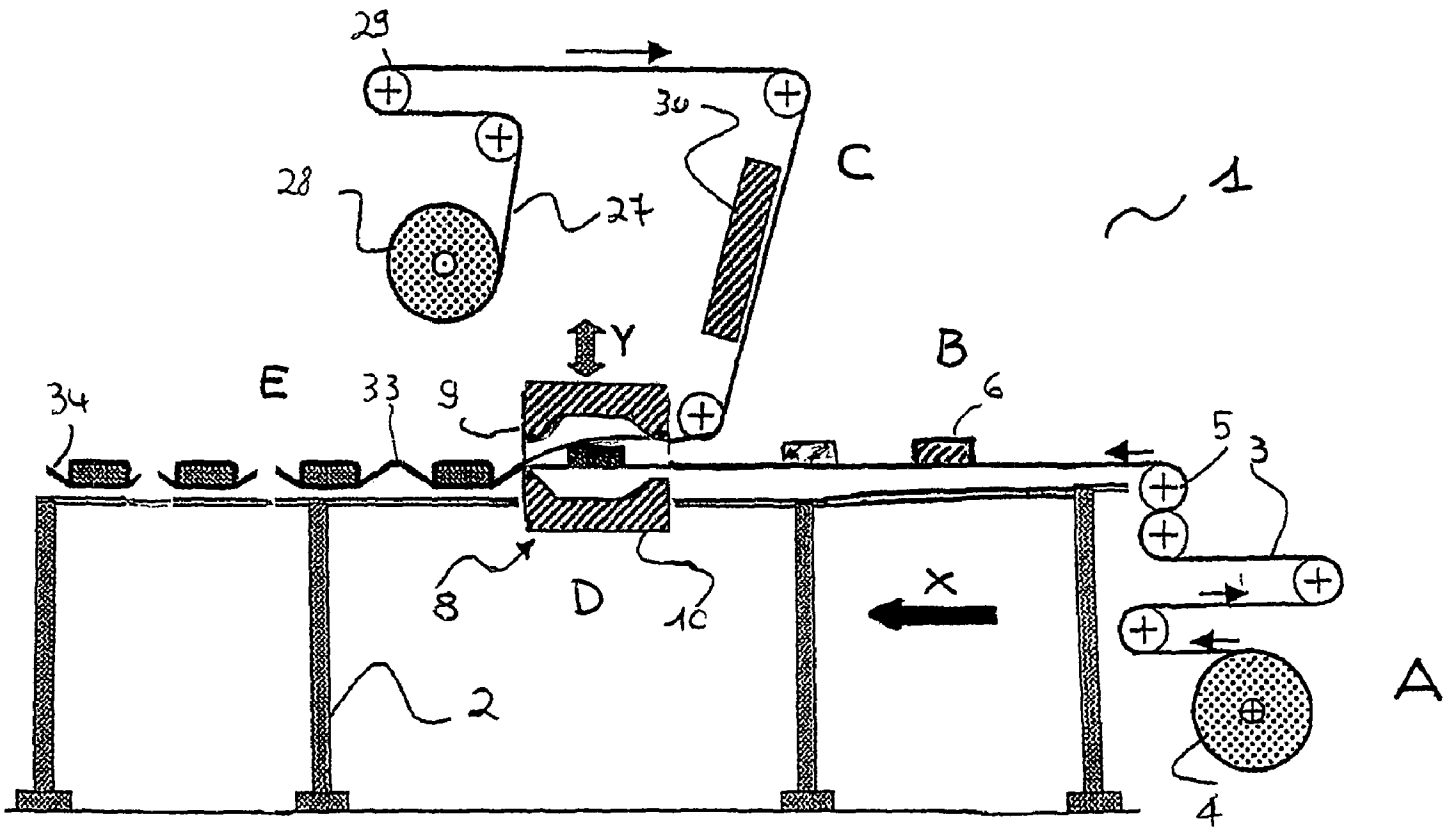
FIG. 1 schematically shows a packaging apparatus according to one embodiment of the present invention.

With reference first to FIG. 1, an apparatus 1 for carrying out the process according of the present invention is shown. In said embodiment loading of the products on the bottom web is carried out in a loading station B separate from and preceding the vacuum skin packaging chamber D. The working direction is indicated by an arrow X and is from right (input side) to left (output side). Arrows also indicate the unwinding of the bottom and top webs. The apparatus comprises a main frame 2 which supports and connects the various stations. A is the unwinding station for the bottom supporting web 3 and in this embodiment it is composed by a first reel 4 and a first pulley arrangement 5. The flat web 3 which is unwound from the reel 4 is then fed to the loading station B of the packaging machine, where the products 6 can be manually or automatically loaded onto the web 3 as known in the art. Means 7 for correctly positioning the products (not shown in the Figures)

can thus be foreseen. These can be suitably selected depending on a number of factors, including the number of packages that are formed per vacuum cycle, and their size, particularly compared with the size of the products to be packaged, and whether the loading is carried out manually or automatically. As an example a loading grid/frame can be employed where the edges of the lines that will then separate one formed tray from the next one are indicated on the frame at the loading station and the operator then load the products in the spaces thus identified. A more sophisticated method may foresee an in-line registered light projection, corresponding to the edges of the forming moulds of the vacuum chamber, on the flat bottom web 3 that stops at the loading station B. Printed references as well as indexing units can alternatively be employed, particularly in the automatic loading.

Figure 2:
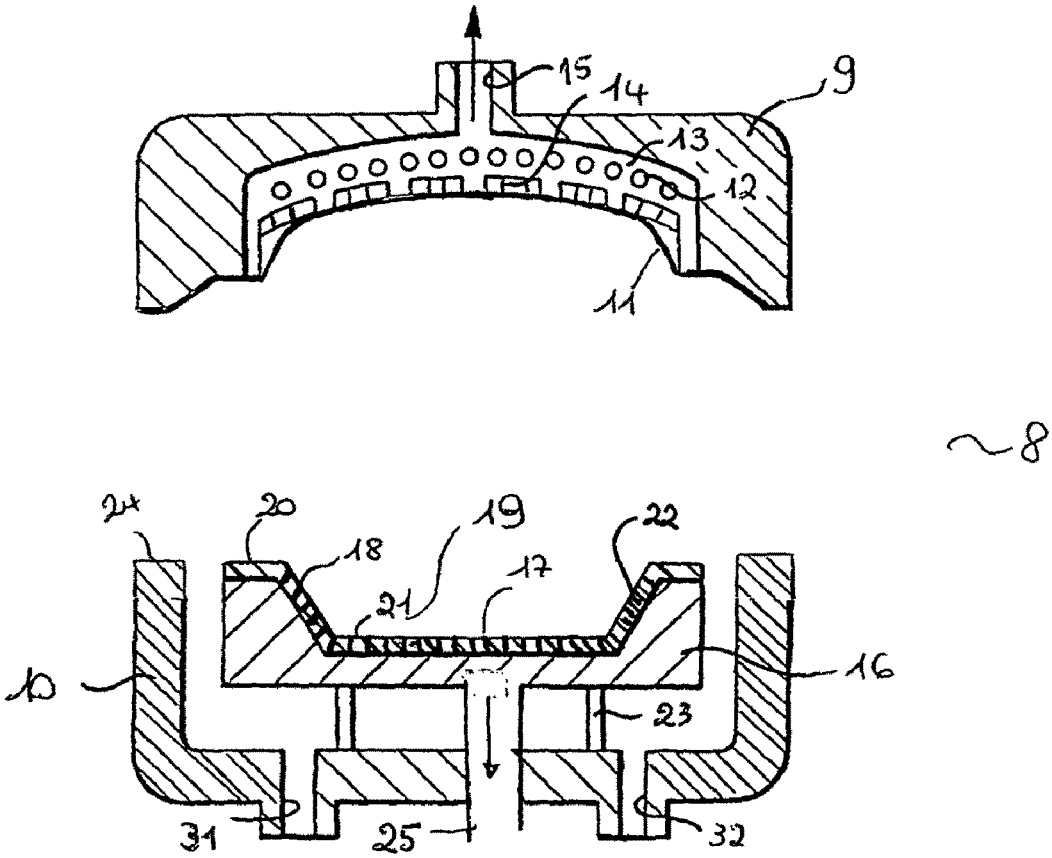
FIG. 2 is a schematic cross section view of a vacuum chamber according to the present invention.

The flat bottom web 3 with the suitably positioned product(s) 6 is then moved to the skin packaging station D where a vacuum chamber 8, shown in the open position, is composed of an upper element 9 and a lower element 10. These upper and lower elements can be moved one towards the other and closed to create an air-tight chamber. FIG. 2 is a schematic cross sectional view of the vacuum skin packaging chamber D in the open position and illustrates in the upper element 9 the presence of a concavity or dome 11, heating rods 12 positioned within dome compartment 13, channels 14 for the passage of air (schematically represented as lines), and port 15. The lower element 10 of the vacuum chamber 8 includes a female vacuum forming mould 16, that generally has a bottom 17 and sidewalls 18 upwardly and typically also outwardly extending from the contour of the bottom 17, thus forming a cavity 19; 20 illustrates the top contoured edge of the cavity 19, that in this embodiment is flat and corresponds to the contour edge of the mould. The top contour edge 20 of the cavity 19 actually may be flat but also and preferably it may be rounded or a combination of a flat element and a curved one, to create an appealable rim for the formed container. Generally furthermore the top surface of the mould 16 will extend beyond the top contour edge 20 of the cavity 19, being provided with engagement means to connect it to the lower element 10. The mould 16 has typically a flat bottom portion, as the cavity 19 will preferably correspond to the shape of the conventional trays widely used in commerce. This however is not strictly necessary. In any case, in the cavity surface 21 a plurality of small air channels 22 (schematically shown as lines) are adapted to draw air from the cavity 19 and thus create the needed vacuum proximate to the cavity surface 21. These channels may also be used for introducing air or a pressurized gas into the cavity 19 after the vacuum cycle to aid in ejecting the end package from the mould. In a preferred embodiment the cavity surface 21 is made of a porous material, such as aluminum. In one embodiment the mould 16 further comprises one other cavity (not shown) outside the container-defining cavity 19, through which a cooling medium may be circulated to maintain the cavity surface 21 at a constant temperature. The mould 16 can be raised and lowered within the lower element 10, by means of conventional drive means 23 within the lower element 10. Preferably however the mould 16 is integral with the lower element 10, with the top edge of the mould 20 being at or almost at the same height of the top lateral edge of the lower element 24. In operation, in this preferred embodiment, the flat bottom web 3 is indexed over the mould 16, and either it is laterally clamped or it is clamped between the vacuum chamber upper and lower elements 9 and 10 when the vacuum chamber 8 closes. Vacuum is drawn in the female mould 16 through channels 22, and port 25 to create a negative pressure at the cavity surface 21, so that when the upper film approaches and/or contacts the lower supporting web, and the heat released softens the lower supporting web, this latter will be pulled inwardly toward the cavity surface 21.

In the packaging process according to the present invention the flat web 3 may be clamped laterally (not shown in FIG. 1) and in such a case preferably the clamping means firmly grasp the flat lower supporting web 3 as soon as it is unwound from the reel 4 and accompany it until or beyond the vacuum chamber. Alternatively suitable clamping means may be set to grasp the flat web just before the vacuum forming step. However as indicated above there is no need for separate clamping means keeping the lower supporting web laterally as the lower supporting web is longitudinally tensioned in the loading and feeding steps, and then it is clamped between the upper and the lower elements of the vacuum chamber when said vacuum chamber is closed.

The female vacuum forming mould 16 is designed to be a tooling that can be changed easily, whenever a change in the number, shape, and/or size of the packages to be formed per vacuum cycle is needed. It will thus be connected with the lower element of the vacuum chamber by means of engagement elements that can be easily actioned as known in the art.

While the shape of the top contoured edge 20 of the female mould 16 is not critical, and it can be squared, rectangular, triangular, round, oval, etc., the sidewalls 18 are generally inclined with respect to the bottom 17, creating an (internal) angle with the bottom 17 of not less than 100°, preferably not less than 102°, more preferably not less than 105°. Typically the sidewalls 18 are inclined with respect to the bottom 17, creating an (internal) angle comprised between about 100° and about 135°. The depth of the mould that can suitably be employed will depend on the formability and on the thickness of the material chosen for the bottom web 3 as well as on the process conditions applied (i.e., the temperature of the heating dome and the effectiveness, in terms of both equipment and conditions, of the vacuum forming system). However a depth of 20-25 mm (i.e., the typical depth of the VSP packages on the market) can be obtained with any of the flexible, semi-flexible, and semi-rigid fully coextruded or laminated thermoplastic sheets actually used as bottom webs in conventional VSP processes where a thermoforming step is involved as the first step, by using temperatures of the heated dome that correspond to those actually used in the conventional VSP process, i.e., typically comprised between 140° C. and 250° C., preferably comprised between 150° C. and 240° C., more preferably comprised between 160° C. and 230° C., and even more preferably comprised between 170° C. and 220° C., depending on the materials employed. Examples of suitable materials are e.g. fully coextruded or laminated polystyrene or amorphous polyester-based structures with a thickness of 200-300 μm, and typically, even if not necessarily, comprising a polyolefin sealant layer as the food contact layer. Preferably however structures suitable as bottom webs in the process of the present invention provide a barrier to the passage of oxygen therethrough, particularly when the product which is packaged is an oxygen sensible product, such as most of the food products. In such a case, in particular it will typically be a multi-layer structure comprising at least a gas-barrier layer and an outer sealant layer, i.e., the layer in contact with the packaged product, which would preferably be a polyolefin layer, to allow an easy sealing of the top web thereto all around the product to be packaged. In such a case it may be a coextruded structure or a laminate structure where e.g. a barrier film, typically including, as seen above, a bather layer and an outer sealant layer, is laminated to a support layer, or an outer sealant layer which is laminated or extruded onto a support layer coated with a barrier material. If no barrier properties are needed or if the top web is suitably chosen to seal or stick anyway to the material of the bottom web, mono-layer structures of e.g. polyester, polypropylene, polyamide, polystyrene, etc. or multi-layer structures where the outer sealant layer is not a polyolefin layer can suitably be employed. The thickness of said bottom web will be comprised between about at least 60 μm and about 500 μm, depending on the depth of the female vacuum forming mould and of the formability of the web. Typical thicknesses are comprised between about 70 and about 450 μm, preferably between about 80 and about 400 μm, more preferably between about 90 and about 350 μm, and even more preferably between about 100 and about 300 μm. Structures that can suitably be employed for said bottom web are e.g., those currently sold by the food packaging division of Sealed Air Inc., Cryovac, as Darfresh® Bottom Webs.

Containers deeper than 25 mm can be obtained by suitably selecting easy formable resins and a thickness of the bottom web in the most preferred range.

A manner to improve the in-chamber forming process and also to get deeper containers, could be the presence of a heating ring, along the top edge of the mould sidewalls.

The forming of the lower supporting web 3 may occur after the upper film 27 has already contacted the lower supporting web, or before said contact occurs while the upper film moves towards the lower supporting web, or it may initiate at this earlier stage and then be completed when the upper film contacts the lower supporting web.

With reference to FIG. 1, the upper film 27 is unwound in unwinding station C from a second reel 28 and a second pulley arrangement 29, and is then fed to the vacuum chamber 8 over and above the bottom web 3 with the loaded product 6. In the embodiment shown in FIG. 1 a heating device 30 is positioned on the top film input side, ahead of the position of supplying said top film to the vacuum chamber. Depending on the formability of the upper film and of the height of the products to be packaged, said heating device may be switched on or off. The vacuum chamber is then closed by approaching the upper element 9 and the lower element 10, preferably lowering the upper element 9 down to close against the lower element 10, and vacuum is applied, through channels 14 and port 15, in the space between the heated dome 11 and the upper film 27 so that the upper film is drawn towards the upper concavity. Typically the height of the upper cavity, in its top, will be comprised between 10 and 100 mm, preferably between 15 and 80 mm, more preferably between 20 and 70 mm. Then the space contained between the upper film 27 and the lower supporting web 3 is evacuated through a port 31, and suitable holes or cuts in the bottom web to connect the space between the bottom and top webs with the port 31, optionally gas flushed through a port 32 and re-evacuated. During the evacuation of the space between the upper web and the lower supporting one, vacuum is maintained through ports 15 and 25, to retain the two webs in their place. Once the desired vacuum is reached in said internal space, vacuum at port 15 is released and atmospheric pressure can be applied through port 15 to move the upper web 27 more rapidly and securely down against product 6 and bottom web 3 and seal thereto. The thermal energy released by the upper web 27, either approaching and/or contacting the lower support web 3 will provide a sufficient heating of the regions of the lower support web not covered by the product to be packaged and in particular of those regions that are adjacent to the edge of the cavity mouth, i.e., those regions where the lower supporting web will be stretched more to provide for the tray side-walls. This, combined with the vacuum in the female mould, will provide for the forming of the lower support web to match the shape of the cavity 19. Thereafter vacuum is released also at port 25, the upper element 9 of the vacuum chamber 8 is raised and the lower element 10 is lowered to allow the connected top and bottom webs with the product sealed therebetween to move out of the vacuum chamber 8. Alternatively once the upper element 9 of the vacuum chamber 8 is raised, the laterally clamped lower supporting web that connects the packages exiting the vacuum chamber also is lifted and moved ahead by the conveyor chains arranged on both sides of the web, thus leaving the female mould 16 into the lower element 10 of the vacuum chamber 8 free for the following cycle. The connected top and bottom webs 33 with the product sealed inbetween are then typically fed to a separating station E where the packages 34 are separated one from the other and the excess packaging material (if any) is removed by winding it on a scrap recovery roll. Separation between the different packages can be obtained by any known means. In a preferred embodiment of the present invention however separation is achieved by means of a laser system as described in co-pending International patent application PCT/EP2007/004717 in the name of the same applicant. The use of a laser system in fact will further increase the flexibility of the packaging system as any change in size, or shape of the formed bottom web will only involve the change of the female vacuum forming mould in the lower element 10 of the vacuum chamber 8 and the suitable setting of a software program for the regulation of the laser cutting system and optionally for the identification of the correct positioning of the products to be packaged on the flat lower supporting web in the loading station. When strips of packaged products are desired, the separation step is simply avoided or is replaced by a step where weakness lines (e.g., by means of perforation lines) are created between the different packages to allow separation of the single ones by tearing when this is needed or desired.

The structure used for the upper web 27 may be a mono- or multi-layer formable film with a thickness generally comprised between about 40 and about 300 μm, preferably comprised between about 45 and about 250 μm, more preferably between about 50 and about 200 μm, and even more preferably between about 55 and about 180 μm.

Preferably the structures used for the upper web are cross-linked, generally by irradiation. When a gas-barrier package is desired the structure for the top web will comprise at least one layer provided with barrier properties. Preferred resins are EVOH, polyamides, polyesters, as well as blends thereof, and preferably at least one outer sealant layer, i.e., the layer in contact with the packaged product, typically a polyolefin layer to improve the sealability of the webs together.

Figure 3:
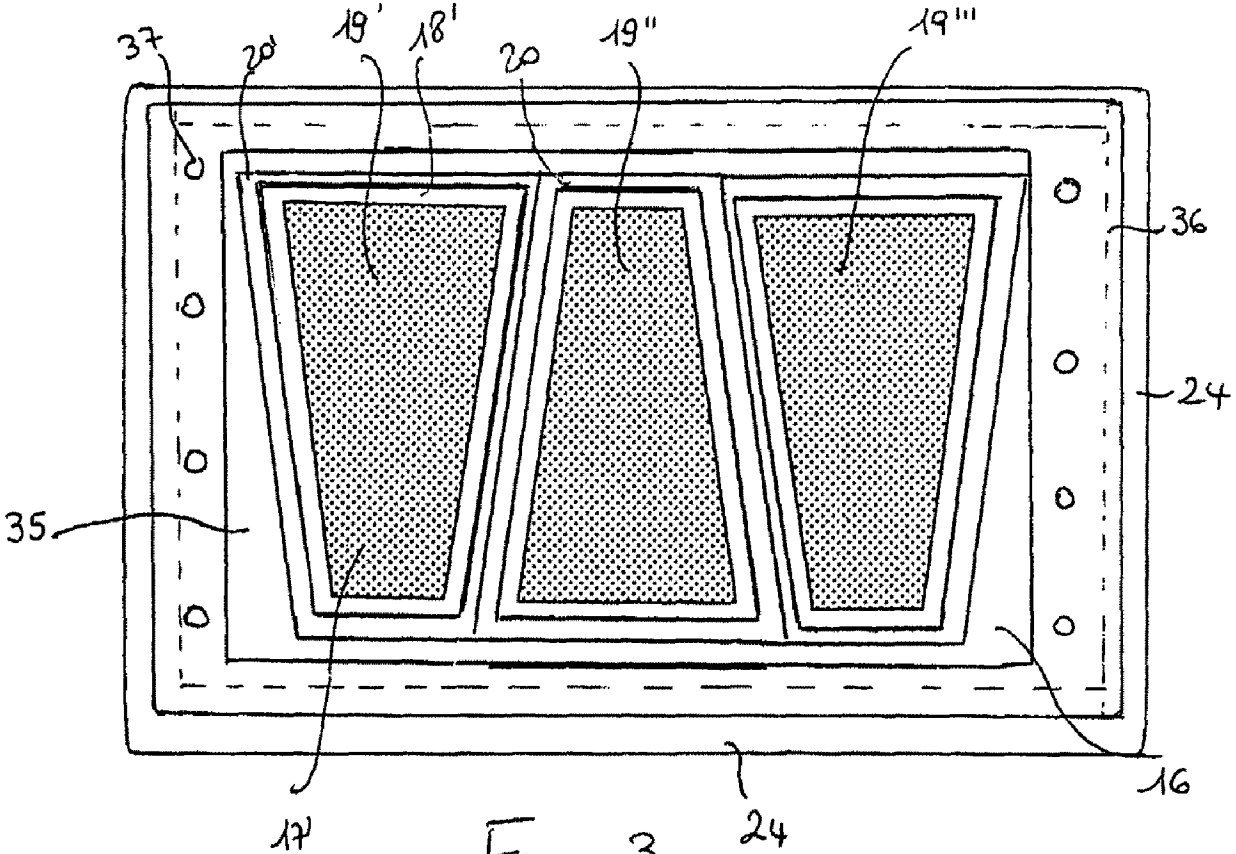
FIG. 3 is a top view of the lower element of the vacuum chamber with a multi-impression female mould.

FIG. 3 represents a top view of a lower element 10 of the vacuum chamber where the female vacuum forming mould 16 comprises a strip of a plurality of connected cavities, indicated as 19', 19", 19''', each of which has a configuration generally conforming to that of the surface contour of the desired container. Even if this is not strictly necessary, these cavities will have generally the same shape, but could be disposed differently. For instance, as illustrated in FIG. 3, when triangular packages are desired, e.g. for chunks of parmesan cheese, the cavities in each row will generally be positioned in parallel but in an inverted manner. While in the embodiment of FIG. 3 the female vacuum forming mould is shown as formed by a plurality of cavities in one single row, the female vacuum forming mould may also be formed by a plurality of cavities in more than one row. In case of a plurality of cavities, each of them will have a plurality of channels in both the base and the sidewalls for discharging air from the cavities during the vacuum forming cycle and possibly for introducing air at the end of the vacuum skin packaging cycle. Also in this case, as with the single mould of FIG. 2, the strip of cavities 19', 19", 19'", can be integral with the lower element 10 or it can be moved vertically within the lower element, being lifted to come into close contact with the flat lower supporting web 3 fed into the vacuum chamber 8, and lowered when the vacuum chamber is reopened at the end of each vacuum cycle, to allow the rows of connected packages with a tray-like shaped lower supporting web to proceed towards the cutting station E. In FIG. 3, the strip of moulds is integral with the lower element 10 of the vacuum chamber, its top surface extends beyond the contour of the cavities by an edge indicated as 35, that is typically large enough to lay on a stepped inner edge on the lower element, indicated as a dotted line 36 in FIG. 3, and be precisely inserted into the opening of the lower element 10. Numeral 37 indicate the slots that are connected with the lower side of the lower element 10 and the evacuation ports 31 and through which the area between the bottom web 3 and the top web 27 will be evacuated once the vacuum chamber is closed.

The invention claimed is:

1. A method for making a vacuum skin package enclosing a product, the method comprising the following steps:

a) positioning the product to be packaged on a lower supporting web having a flat configuration and comprising thermoplastic material;

b) feeding both (1) the lower supporting web having the flat configuration and loaded with the product and (2) an upper web comprising thermoplastic material positioned above the lower supporting web and the product, to a vacuum chamber machine comprising:

an upper element comprising a heated upper concavity and a lower element comprising a female vacuum forming mold defining a cavity;

c) closing the upper element and the lower element of the vacuum chamber machine together to provide chamber;

d) drawing the upper web to contact the heated upper concavity and heat the upper web;

e) drawing the lower supporting web to contact the female vacuum forming mold of the lower element, thereby creating a space between the lower supporting web and the upper web in the chamber;

f) evacuating air or gases from the space between the lower supporting web and the upper web in the chamber, while maintaining the upper web and the lower supporting web in contact with the heated upper concavity and the female vacuum forming mold, respectively;

g) subsequently moving the heated upper web against the product and the lower supporting web while retaining the lower supporting web in contact with the female vacuum forming mold, wherein the lower support web is formed to conform to and retain the shape of the cavity and the upper web is bonded to the lower supporting web all around the product thereby creating a vacuum skin package enclosing the product.

2. The method of claim 1 where the upper concavity is heated to a temperature comprised between 120° C. and 250° C.

3. The method of claim 1 wherein the lower support web is formed to a depth of from 20 to 25 mm.

4. The method of claim 1 wherein the lower supporting web is a flexible, semi-flexible, or semi-rigid thermoplastic sheet with a thickness of from about at least 60 μm up to about 500 μm.

5. The method of claim 1 wherein the upper web is a mono- or multi-layer formable film with a thickness comprised between about 40 and about 300 μm.

6. The method of claim 1 wherein an in-line registered light projection is used in positioning the product to be packaged on the lower supporting web having the flat configuration.

7. The method of claim 1 wherein the lower supporting web is formed in a tray-like shape having a flat bottom and upwardly and outwardly projecting sidewalls.

8. The method of claim 7 wherein the sidewalls are inclined with respect to the flat bottom creating an angle of not less than 100°.

9. The method of claim 1 wherein the lower supporting web having the flat configuration is not thermoformed before feeding it into the vacuum chamber machine.

10. The method of claim 1 wherein the lower support web is formed to a depth of more than 25 mm.

11. The method of claim 1 where the upper concavity is heated to a temperature comprised between 130° C. and 240° C.

12. The method of claim 1 where the upper concavity is heated to a temperature comprised between 140° C. and 230° C.

13. The method of claim 1 where the upper concavity is heated to a temperature comprised between 150° C. and 220° C.

14. The method of claim 1 wherein the lower supporting web is a flexible, semi-flexible, or semi-rigid thermoplastic sheet with a thickness comprised between about 70 and about 450 μm.

15. The method of claim 1 wherein the lower supporting web is a flexible, semi-flexible, or semi-rigid thermoplastic sheet with a thickness comprised between about 80 and about 400 μm.

16. The method of claim 1 wherein the lower supporting web is a flexible, semi-flexible, or semi-rigid thermoplastic sheet with a thickness comprised between about 90 and about 350 μm.

17. The method of claim 1 wherein the lower supporting web is a flexible, semi-flexible, or semi-rigid thermoplastic sheet with a thickness comprised between about 100 and about 300 μm.

18. The method of claim 1 wherein the upper web is a mono- or multi-layer formable film with a thickness comprised between about 45 and about 250 μm.

19. The method of claim 1 wherein the upper web is a mono- or multi-layer formable film with a thickness comprised between about 50 and about 200 μm.

20. The method of claim 1 wherein the upper web is a mono- or multi-layer formable film with a thickness comprised between about 55 and about 180 μm.

* * * * *